United States Patent [19]

Dougherty

[11] 3,982,329

[45] Sept. 28, 1976

[54] METHOD AND APPARATUS FOR DRYING GRAIN

[76] Inventor: Harold F. Dougherty, R.R. No. 2, Burchard, Nebr. 68323

[22] Filed: Aug. 26, 1974

[21] Appl. No.: 500,748

Related U.S. Application Data

[63] Continuation of Ser. No. 363,512, May 24, 1973, abandoned, and a continuation-in-part of Ser. No. 328,042, Jan. 30, 1973, abandoned.

[52] U.S. Cl. ..... 34/22; 34/34; 34/229; 34/233

[51] Int. Cl.[2] ..... F26B 3/06

[58] Field of Search ..... 34/15, 22, 33, 34, 64, 34/165, 168, 174, 175, 211, 225, 227, 235, 230, 232, 233, 223, 224; 431/196, 198; 432/99, 102, 119, 144, 222

[56] References Cited

UNITED STATES PATENTS

| | | | |
|---|---|---|---|
| 2,000,103 | 5/1935 | Shodron | 34/225 |
| 2,134,229 | 10/1938 | Lipscomb | 432/99 |
| 2,597,062 | 5/1952 | Cardella et al. | 431/198 |
| 3,001,465 | 9/1961 | Donelson, Jr. | 34/168 |
| 3,041,684 | 7/1962 | Dawson et al. | 34/225 |
| 3,403,456 | 10/1968 | Smith, Jr. | 34/160 |
| 3,727,323 | 4/1973 | Meiner et al. | 34/210 |
| 3,893,244 | 7/1975 | Danford | 34/22 |

*Primary Examiner*—John J. Camby
*Assistant Examiner*—Larry I. Schwartz
*Attorney, Agent, or Firm*—Darbo, Robertson & Vandenburgh

[57] ABSTRACT

A subatmospheric air pressure is applied to the bottom of a grain bin so that the air flows down through the grain from a top opening in the bin. Heated air, at atmospheric pressure or above, is introduced into the bin above the top of the grain. This air may be distributed above the grain to flow down through it.

17 Claims, 7 Drawing Figures

METHOD AND APPARATUS FOR DRYING GRAIN

RELATED APPLICATION

This application is a continuation of pending application Ser. No. 363,512, filed May 24, 1973, abandoned, which was a continuation-in-part of my application Ser. No. 328,042, filed Jan. 30, 1973, now abandoned.

SUMMARY OF THE INVENTION

The present invention relates to an improved method and apparatus for speeding the drying of grain in bins such as those used on or in the vicinity of a farm by applying a subatmospheric pressure to the interior of the bin at one end, more specifically the bottom, and heating the incoming air at the other end, that is the top that is open to atmosphere.

DESCRIPTION OF SPECIFIC EMBODIMENT

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvement.

Figure 1:
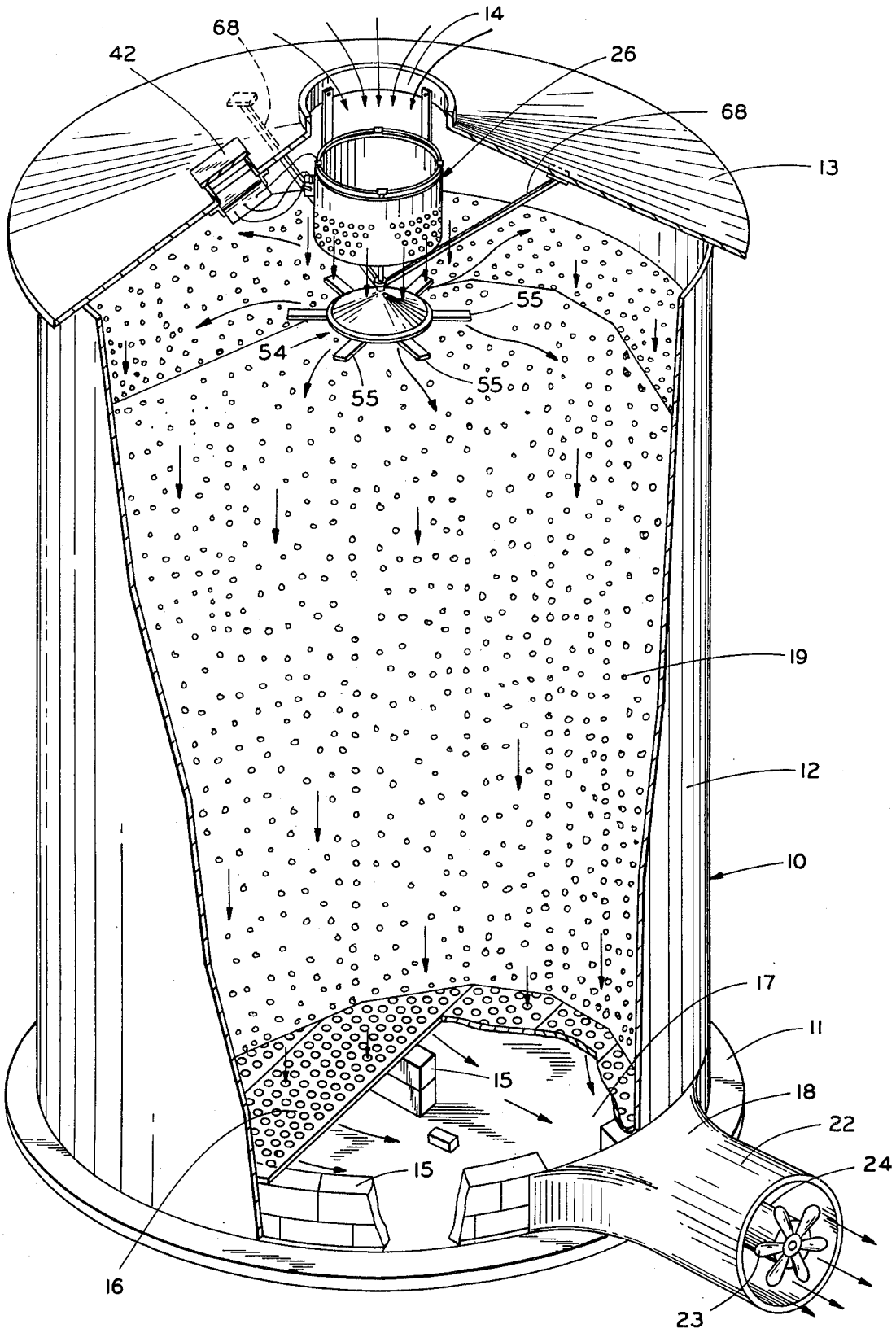
FIG. 1 is a perspective view, partially broken away, of an embodiment of the invention.
Figure 4:
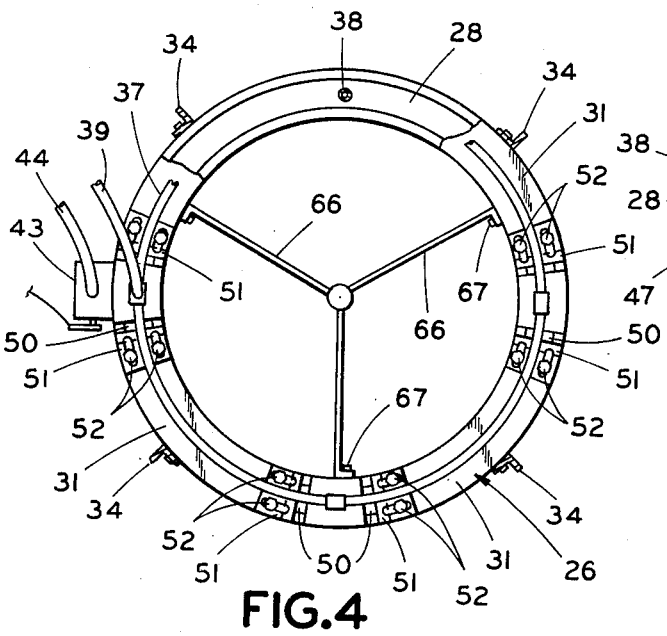
FIG. 4 is a plan view of the burner as seen at line 4—4 of FIG. 2.
Figure 3:
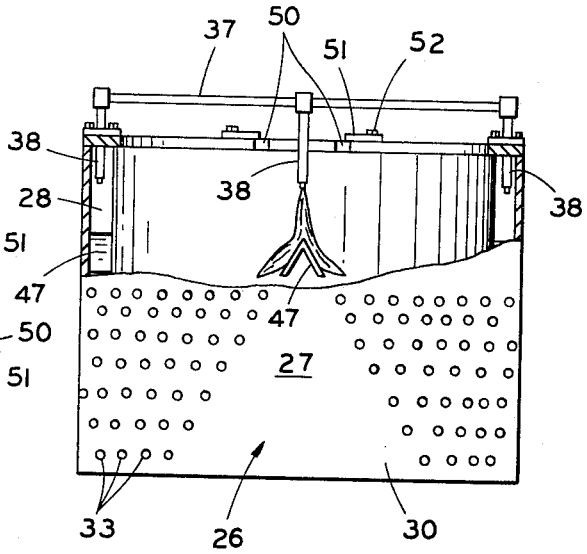
FIG. 3 is an elevational view, partially broken away, of the burner.
Figure 2:
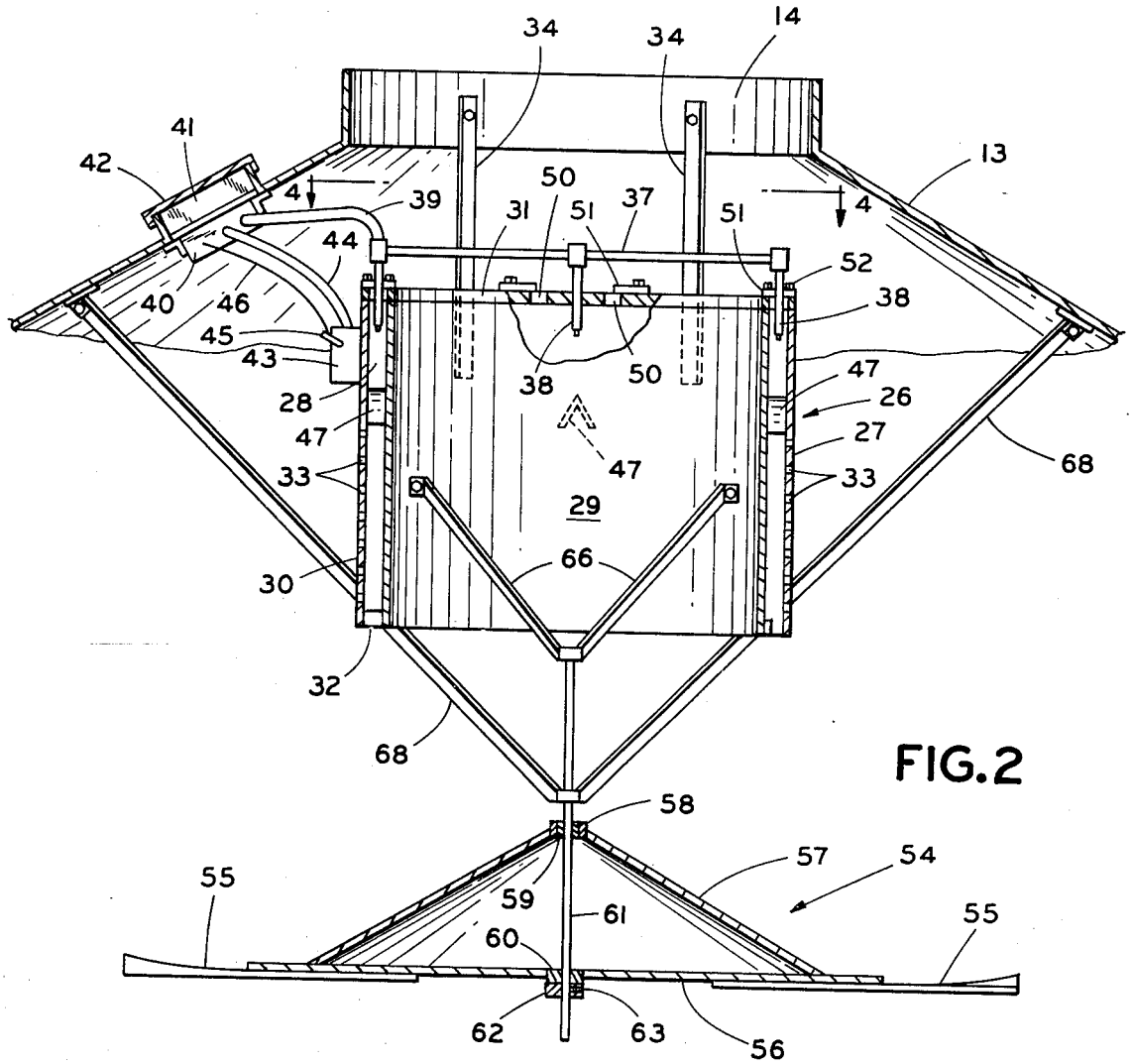
FIG. 2 is a vertical section through the top of the bin and the burner.

FIG. 1 illustrates a grain bin, generally 10, supported on a suitable foundation 11. The bin has an annular sidewall 12 and at the top is closed by a roof 13. The roof has a top opening 14. At the bottom interior of the bin are a plurality of supports 15 which carry a perforated floor 16 and define an open space 17 below the floor. A duct 18 communicates with the open space 17 and defines a bottom opening to the bin. The purpose of the bin is to hold a charge of corn 19, or other grain to be dried. As thus far described, the structure is conventional.

A fan housing 22 is attached to duct 18 (which forms an intake for the blower means) and thus the interior of the housing communicates with the bottom opening in the bin. Within the housing is a fan 23 a blower means driven by an electric motor 24. A suitable guard, not shown, would be provided to protect against accidental contact with the fan. The fan operates in a direction such that air is exhausted from the space 17 at the bottom of the bin. Thus the fan applies a subatmospheric pressure to that space. A top opening 14 in the bin is exposed to atmospheric pressure thus the air flow is downward through the corn due to the atmospheric pressure at the top and the subatmospheric pressure at the bottom.

Below the top opening 14, and axially positioned with respect thereto, is a suitable heating means for heating the air entering through opening 14. In the illustrated embodiment this heating means is a gas burner, generally 26, but it could by any other suitable source of heat, as for example an electric heater. The gas burner comprises an annular body 27 having an internal opening 28. This body is defined by an inner wall 29, an outer wall 30, the top plate 31 and bottom spacers 32. The outer wall has a plurality of small burner openings 33. The body 27 is suspended from the roof 13 by mounting brackets 34.

At the top of the body 27 there is a gas manifold 37. Depending from the manifold are four gas nozzles 38. These nozzles extend through openings in top plate 31 and are positioned in the internal opening 28 in the burner body. The arrangement is such that the manifold and nozzles may be lifted vertically to remove the nozzles from the internal opening for cleaning. The manifold is connected by a hose 39 to a conventional gas control 40. Control 40 is immediately adjacent an access opening 41 in roof 13. Opening 41 is closed by a removable cover 42.

A pilot light support 43 is mounted on the body 27. Gas supply to the pilot light is provided by a hose 44 connecting the pilot light support 43 and the controls 40. The controls are connected by a conduit, not shown, to a suitable source of gas, such as an LP (liquid petroleum) gas tank. A pilot light sensor 45 is positioned so as to be heated by the pilot light when the pilot light is on. The sensor is connected to the controls by a connection 46. Normally such a sensor would be a thermocouple. Below each of the nozzles 38, within the internal opening 28 in the burner body, is an inverted V-shaped deflector 47 to spread out the gas jet flowing downwardly from the nozzle.

At each side of the nozzles there is an air opening 50 in the top plate 31. At each of these air openings there is an adjustable shutter 51 held in place by a pair of screws 52 which extend through elongated openings in the shutter. By moving the shutter the size of the exposed part of opening 50 may be varied, thus varying the amount of air that will be drawn into the internal opening in the burner to be mixed with the gas. When each shutter is properly adjusted, it is fixed in place by tightening screws 52 threaded into the top plate 31 of the burner body.

Suspended below, the gas burner and coaxial therewith is an air distributor, generally 55. This distributor consists of a flat plate 56 to which is affixed a conical top 57. A hub 58 secured to the uppermost portion of top 57 carries a bearing 59. The plate 56 forms a hub which carries a bearing 60. A vertical shaft 61 is journaled in bearings 59 and 60. Bearing 60 also rides on a collar 62 attached to shaft 61 by set screw 63.

A plurality of brackets 66 are affixed to the top end of shaft 61 and are connected to burner body 27 by bolts 67. A second set of brackets 68 also are attached to the shaft and are secured to a roof 13 of the bin. These brackets hold the shaft in the required position.

The pilot light on the burner can be lighted by reaching in through opening 41 (after removing cover 42) and suitably manipulating the gas controls 40 while applying a light to the pilot light. With the pilot light lit, the burner can be turned on when it is desired to dry grain. It is not necessary to turn the burner off as the corn is being introduced, although it may be desirable to turn the flame down at that time. The corn may be inserted into the bin through top opening 14 (or some other suitable opening, not shown). The corn entering through opening 14 will pass through the open center of the burner body 27. Upon reaching the conical top 57 of the air deflector it will, at random, be deflected to various parts of the bin. When the burner is turned on to dry the corn, the fan 23, 24 is also energized to apply a subatmospheric pressure to the bottom of the bin and thus draw the air down through the corn and drying the same. The downwardly moving air at the top of the bin contacts blade 55. As this air is deflected off of the blade it causes the air distributor 54 to rotate on shaft 61. This stirs the heated air descending from about burner 26. The descending air also is deflected outwardly by the conical top 57. The fan also may be run without the burner turned on high, or even at all. This will vary with the preferences of the user.

The conventional method and apparatus for drying grain is that the grain is put into a bin (similar to that illustrated). A fan communicating with the bottom duct 18 forces heated air into the space 17 at the bottom of the bin. The top opening 14 is open to atmosphere. Thus the heated air rises through the corn and exits from the top of the bin.

As compared to this conventional structure, the method and apparatus of the present invention does a much better, more economical and more satisfactory job. There are a number of factors that contribute to this overall improvement.

In the first place, the interior of the bin is not pressurized (with respect to atmospheric pressure), rather it is placed under a vacuum. Since the atmosphere about the corn is thus at a reduced pressure, there is a greater pressure differential between the vapor pressure of the atmosphere about the corn and the vapor pressure of the water in the corn. This increased differential speeds the exiting of the water from the corn to the passing air.

Also, I am convinced that more uniform flow of the air through the corn is achieved, at less expense, than is the case where a motorized fan is employed to pressurize the interior of the bin so as to achieve the airflow therethrough. Using the concept of applying a subatmospheric pressure an adequate air flow can be produced with a smaller motor than that necessary when the bin is pressurized.

Another important feature is that the corn having the highest water content normally is exposed to the greatest amount of heat. It is quite common that these drying bins are not completely filled in one operation. They will be partially filled and the drying commenced. After some drying time, additional corn will be added to the bin followed by additional drying, and so on. This means that the most recently added corn, which also contains the most moisture, will always be at the top of the bin. With the conventional system the corn at the bottom of the bin will dry first yet the hottest air will continue to be introduced at the bottom of the bin where this dry corn is located. Using my invention, the hottest air will always be applied initially to the corn at the top of the bin and this is the wettest corn when the practice of adding successive amounts is followed. Furthermore, the corn shrinks as it dries and thus following the prior art process the shrinkage occurs at the bottom of the bin which sometimes results in collapse or buckling of the bin walls as the corn shrinks. Using my invention, the corn having the most shrinkage will not be at the bottom of the bin.

With the conventional practice, water will condense on the under side of the roof during cold weather. At least some of this water drips back onto the corn. Using the downward draft principle of my invention this will not occur. If there would be any condensation (which is unlikely) it would be on the bottom below the corn or in the exhaust pipe 18 where it doesn't remoisten the corn.

Figure 5:
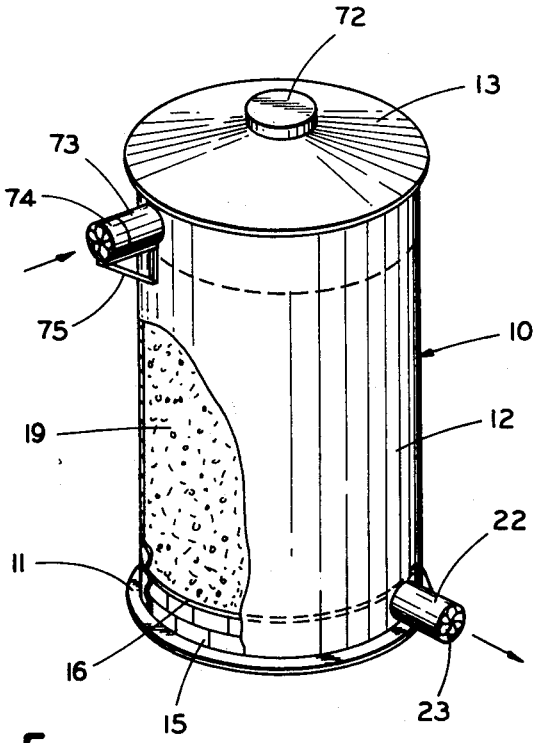
FIG. 5 is a perspective view of an alternative embodiment.

FIG. 5 illustrates a bin, generally 10, similar to that of FIG. 1. Again, there is a fan housing 22 communicating with the interior of the bin below the perforated floor 16. In housing 22 there is an exhaust fan 23 to apply a subatmospheric pressure to the space below floor 16. The fill opening at the top of the bin is supplied with a cover 72. Communicating with the interior of the bin above the upper surface of the grain is an assembly comprising an air heater 73 (of conventional design) and a fan assembly 74. These may be supported by suitable brackets such as 75. The fan 74 forces the air through the heater 73 into the top of the bin from whence the heated air flows down through the top of the bin to be drawn out at the bottom by fan 23.

Figure 6:
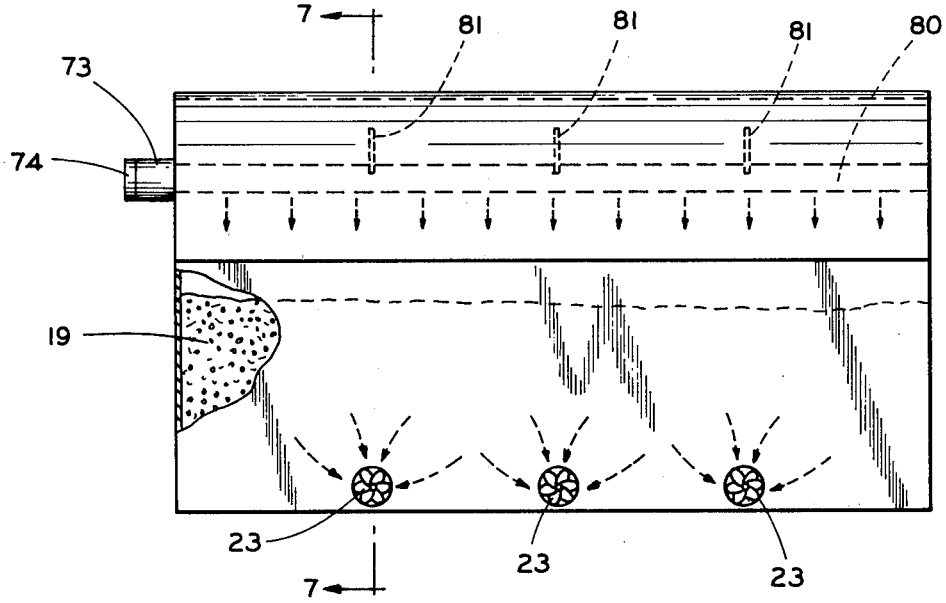
FIG. 6 is an elevational view of another alternative embodiment.
Figure 7:
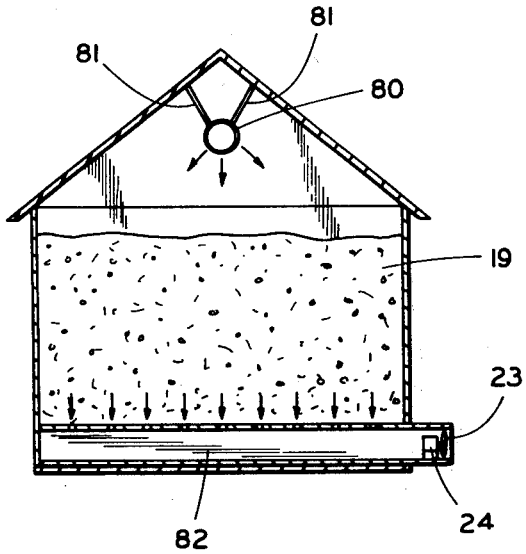
FIG. 7 is a section taken at line 7—7 of FIG. 6.

In the farm areas not all of the grain is stored and dried in cylindrical bins, but a substantial amount of it is in bins of other shapes. For example, buildings of the familiar Quonset hut configuration are often employed for grain storage. FIGS. 6 and 7 illustrate how the present invention may be employed in conjunction with a building having a rectangular configuration with a gable roof. Extending the length of the building above the grain 19 is a perforated conduit 80. It is suspended from the roof as by means of hangers 81. One end of the duct is closed, and communicating with the other end is an air heater 73 and a fan assembly 74. The fan 74 forces air through heater 73. The heated air exits through the perforations in duct 80 and flows downwardly therefrom over the top of the corn 19 as indicated by the arrow. In the opposite direction across the bottom of the building are a plurality of perforated conduits 82. Again, one end of each conduit 82 is closed and the other end communicates with an exhaust fan 23. Thus the air is drawn through the bottom layers of grain, into the conduit 82 and out through the open end. The number of conduits 82 employed will depend upon the length of the building. Of course, they could be connected together by a manifold with a single exhaust fan being employed to apply a subatmospheric pressure to each of the conduits simultaneously. In some embodiments it will be satisfactory for the upper conduit 80 to be eliminated, with the heated air merely being discharged from the heater 73 into the space at the top of the building above the level of the grain 19 therein.

I claim:

1. In an apparatus for drying grain in a bin having ambient air thereabout and of the type used on or in the vicinity of the farm where the grain is grown and having openings at the top and at the bottom of the bin with the grain being held static in the bin in a location between the openings, the top opening being exposed to ambient air pressure, the improvement comprising:

blower means having an intake communicating with the bottom of said openings to apply a subatmospheric pressure to said one opening, thus introducing air into the top opening substantially at ambient pressure, said blower means discharging into said ambient air;

means communicating with said top opening and said ambient air to heat the ambient air entering the top opening before said air reaches the top layer of the grain in the bin;

whereby an air flow of heated air obtained from said ambient air is created downwardly through the entire depth of said grain.

2. In an apparatus as set forth in claim 1, wherein said top opening defines a vertical axis, and said heating means is mounted on said bin and is positioned about said axis.

3. In an apparatus as set forth in claim 2, including air distributing means mounted within said bin, below the heating means and above the grain.

4. In an apparatus as set forth in claim 3, wherein said air distributing means is axially below said top opening and includes a hub with a plurality of blades extending therefrom, said hub being mounted for rotation about a vertical axis.

5. In an apparatus as set forth in claim 4, wherein said heating means comprises a gas burner positioned generally between said air distributing means and said top opening.

6. In an apparatus as set forth in claim 2, wherein said heating means comprises:

an annular double walled body with an internal opening between the walls thereof, at least one of the walls having a plurality of burner openings therein, the space within the inner of the walls of the body being open from top to bottom, the body having wall means at the top and bottom of said walls and extending between said walls to close off said internal opening at the top and bottom, means communicating with said internal opening to introduce a combustible mixture of gas and air into said internal opening.

7. In an apparatus as set forth in claim 1, wherein the top opening is exposed to atmospheric pressure.

8. In an apparatus as set forth in claim 1, including means communicating with said other opening to apply air under pressure above atmospheric to said other opening.

9. In an apparatus as set forth in claim 1, wherein said bin is rectangular, the improvement comprising:

a plurality of perforated conduits extending across the lower part of the bin in one direction, one of said conduits forming said bottom opening, said blower means also communicating with the remainder of said conduits to apply said subatmospheric pressure thereto.

10. In an apparatus as set forth in claim 9, including a perforated conduit extending across the top of said bin at right angles to said one direction, said perforated conduit forming said top opening.

11. In an apparatus as set forth in claim 6, wherein said heating means comprises:

said burner openings being only in the outer wall of said body;

said means for introducing a combustible mixture comprising a plurality of nozzles directed downwardly through said top wall means of said body into the internal opening, a gas manifold connecting said nozzles, and means for connecting said manifold to a suitable source of gas, said top wall means of said body having openings adjacent the nozzle through which air is aspirated into said internal opening by reason of the gas flowing from said nozzles.

12. In an apparatus as set forth in claim 11 and including:

a deflector in the form of a cone below said body, the base of said cone having a diameter approximately at least as great as the diameter within the inner wall of said body, whereby grain and air descending through the space defined by the inner wall of said body will be deflected outwardly by said deflector.

13. In the method of drying grain in a storage bin in which the grain is held in a static condition, on or in the vicinity of the farm where the grain is grown and where there is ambient air externally of said bin, wherein heated air obtained by heating air drawn from said ambient air is passed vertically through the bin and thus through the grain in the bin, and then discharging the air that has passed through the grain into said ambient air, the improvement comprising the steps of:

passing said heated air vertically downward through the whole height of the grain in said bin, applying ambient air pressure to the upper part of said bin above the upper level of the grain therein, applying a pressure substantially below ambient air pressure to the bottom of said bin, to thereby achieve said downward air flow through said bin and the grain therein.

14. In the method of claim 2 applied to the grain in a bin which has a top opening through which air enters to maintain said air pressure at ambient, wherein said heated air is obtained by heating, within the bin, the air that is entering the top opening of the bin.

15. In the method of claim 14 including the step of stirring the air in the top of the bin above the grain.

16. In an apparatus for drying grain in a bin having ambient air thereabout and of the type used on or in the vicinity of the farm where the grain is grown, said bin having an outside wall and a roof over said wall and with a centrally located opening in said roof, a perforated floor adjacent the bottom of the bin, said bin defining a first space above the floor to hold the grain in a stationary pile in said first space and a second space between the floor and the bottom of the bin, said perforated floor permitting air to flow through the perforations therein from one of said spaces to the other, said bin wall having a bottom opening below said floor and directly communicating with said second space, blower means having an exhaust and an intake and communicating with said bin to create an air flow through the bin between said openings which air flow necessarily must pass through said spaces, said grain in the first space and said perforations in the floor with the air entering one of the openings and exiting from the other of the openings, and means for heating the entering air before it reaches the grain in said pile, the improvement comprising:

said one opening being the top opening, said top opening being in direct communication with the ambient air so that the entering air is at ambient air pressure, whereby the part of said first space above said pile of grain is at ambient air pressure, said blower means intake communicating directly with said bottom opening and its exhaust communicating directly with ambient air, whereby the blower means creates a pressure below ambient in said second space, whereby the air flow through said pile of grain is downward with said ambient pressure existing immediately above the pile and said pressure below ambient existing immediately below the pile.

17. In an apparatus as set forth in claim 16, wherein said heating means is below said roof and within said first space.

* * * * *

UNITED STATES PATENT AND TRADEMARK OFFICE

CERTIFICATE OF CORRECTION

PATENT NO. : 3,982,329

DATED : September 28, 1976

INVENTOR(S) : Harold F. Dougherty

It is certified that error appears in the above-identified patent and that said Letters Patent are hereby corrected as shown below:

Column 1, line 41, "improvement" should read --improvements--.
Column 1, line 56, "a blower means" should read --(a blower means)--.
Column 2, line 3, "by" should read --be--.
Column 2, line 35, --each of-- should be inserted after "of".
Column 2, line 46, delete the comma after "below"
Column 4, line 61, "one" should read --bottom--.
Column 6, line 23, "2" should read --13--.

Signed and Sealed this

Twenty-second Day of February 1977

[SEAL]

*Attest:*

RUTH C. MASON
*Attesting Officer*

C. MARSHALL DANN
*Commissioner of Patents and Trademarks*